US008867945B2

(12) United States Patent
Takiguchi et al.

(10) Patent No.: US 8,867,945 B2
(45) Date of Patent: Oct. 21, 2014

(54) IMAGE FORMING APPARATUS

(71) Applicant: Sharp Kabushiki Kaisha, Osaka (JP)

(72) Inventors: Toshiki Takiguchi, Osaka (JP); Hiroyuki Murai, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 146 days.

(21) Appl. No.: 13/687,284

(22) Filed: Nov. 28, 2012

(65) Prior Publication Data

US 2013/0142537 A1 Jun. 6, 2013

(30) Foreign Application Priority Data

Dec. 1, 2011 (JP) ..... 2011-263660

(51) Int. Cl.
*G03G 15/00* (2006.01)
*G03G 21/00* (2006.01)

(52) U.S. Cl.
CPC ..... *G03G 21/00* (2013.01)
USPC ..... 399/71

(58) Field of Classification Search
USPC ..... 399/49, 71, 72
See application file for complete search history.

(56) References Cited

U.S. PATENT DOCUMENTS 7,764,889 B2 * 7/2010 Hamaya et al. ..... 399/44
8,391,739 B2 * 3/2013 Kobayashi ..... 399/71

FOREIGN PATENT DOCUMENTS

| | | |
|---|---|---|
| JP | 2006-251138 | 9/2006 |
| JP | 2007-240768 | 9/2007 |
| JP | 2008-182716 | 8/2008 |
| JP | 2010-122468 | 6/2010 |

* cited by examiner

*Primary Examiner* — Hoang Ngo
(74) *Attorney, Agent, or Firm* — Nixon & Vanderhye, P.C.

(57) ABSTRACT

An image forming apparatus includes: an image bearing element that bears a toner image to be transferred to a sheet; an image forming portion that forms the toner image on the image bearing element; a cleaning element that cleans the surface of the image bearing element; a storage portion that stores a history of print coverage; a control portion that makes the image forming portion form a cleaning toner image to be supplied to the image bearing element at time of cleaning by the cleaning element; and a print coverage calculating portion that calculates the print coverage of the sheet. The control portion obtains an average value of the print coverage in a period from after a previous cleaning by the cleaning element until before a current cleaning, and determines an amount of toner for the cleaning toner image supplied to the image bearing element based on the average value.

5 Claims, 8 Drawing Sheets

FIG.2A

602

| No | DATE : HOUR : MINUTE | PRINT COVERAGE (%) |
|---|---|---|
| 1 | 2011/12/10 10:15 | 4.3 |
| 2 | 2011/12/10 10:15 | 4.3 |
| . . . | . . . | . . . |
| 11 | 2011/12/10 10:30 | 2.5 |
| 12 | 2011/12/10 10:30 | 2.5 |
| . . . | . . . | . . . |
| 25 | 2011/12/10 12:01 | 3.3 |
| 26 | 2011/12/10 12:01 | 3.3 |
| . . . | . . . | . . . |
| 126 | 2011/12/10 14:08 | 5.2 |
| . . . | . . . | . . . |

FIG.2B

603

| No | DATE : HOUR : MINUTE |
|---|---|
| 1 | 2011/12/10 12:10 |
| 2 | 2011/12/10 18:00 |
| . . . | . . . |

IMAGE FORMING APPARATUS

CROSS REFERENCE

This Nonprovisional application claims priority under 35 U.S.C. §119(a) on patent application Ser. No. 2011-263660 filed in Japan on Dec. 1, 2011 the entire contents of which are hereby incorporated by reference.

BACKGROUND OF THE INVENTION

The present invention relates to an image forming apparatus that makes a cleaning toner image to be born on the surface of an image bearing element and then cleans the surface of the image bearing element by a cleaning element.

Some electrophotographic image forming apparatuses are configured to transfer a toner image that is born on an image bearing element, such as a photoreceptor drum and an intermediate transfer element, onto a sheet in a transfer position between the image bearing element and the transfer element. After the toner image is transferred onto the sheet, if residual toner which has remained on the surface of the image bearing element is not removed and the next image forming process is performed, the image quality of the image formed on the sheet will deteriorate, so that it is necessary to remove the residual toner by cleaning the surface of the image bearing element after the toner image is transferred.

When the image bearing element is being cleaned and the toner on the surface of the image bearing element is low, if the surface of the image bearing element contacts the cleaning element to be cleaned, friction will increase between the surface of the image bearing element and the cleaning element and will damage the surface of the image bearing element. In addition, when the toner on the surface of the image bearing element is high, if the surface of the image bearing element contacts the cleaning element to be cleaned, the toner will leak to the downstream side of the cleaning element in the moving direction of the surface of the image bearing element. Therefore, when the image bearing element is being cleaned, the predetermined amount of toner without excess or insufficiency needs to exist on the surface of the image bearing element. Accordingly, one conceivable approach is to supply cleaning toner so that the predetermined amount of toner may exist on the surface of the image bearing element before the surface of the image bearing element contacts the cleaning element.

For example, the image forming apparatus disclosed in Japanese Patent Laid-Open Publication No. 2006-251138 adjusts the amount of cleaning toner to be supplied according to the image density of the image data used for the immediately preceding image forming process in consideration that the amount of the residual toner that adheres to the surface of the image bearing element decreases as the image density of the image data used for the immediately preceding image forming process is lower.

It is to be noted that the image density in an electrophotographic image forming apparatus may preferably represent an image dot ratio that indicates a value obtained by dividing an area of an image part by an area of the sheet, the image part being converted from a number of dots of an ON signal in the image data; and is a concept included in print coverage. The print coverage is a concept that may preferably include an image area ratio as well as the image dot ratio, the image area ratio indicating a value obtained by dividing an integrated area of the image part of the sheet that has been subjected to an image forming process by the area of the sheet.

However, since the residual toner is accumulated on the surface of the image bearing element every time the image forming process is performed, even if the print coverage of the immediately preceding image forming process is low, the amount of toner that adheres to the surface of the image bearing element may increase. In addition, even if the print coverage of the immediately preceding image forming process is high, the amount of toner that adheres to the surface of the image bearing element may decrease. When the amount of the cleaning toner is adjusted only according to the print coverage in the immediately preceding image forming process and is supplied to the surface of the image bearing element, the toner that exists on the surface of the image bearing element might become excessive or insufficient.

In view of the foregoing, it is an object of the present invention to provide an image forming apparatus that can supply cleaning toner to the surface of an image bearing element without excess or insufficiency and clean the surface of the image bearing element by adjusting the amount of the cleaning toner according to the print coverage of a sheet in a predetermined period.

SUMMARY OF THE INVENTION

An image forming apparatus according to the present invention includes an image bearing element, an image forming portion, a cleaning element, a print coverage calculating portion, a storage portion, and a control portion. The image bearing element bears a toner image to be transferred to a sheet. The image forming portion forms the toner image on the image bearing element. The cleaning element cleans the surface of the image bearing element. The print coverage calculating portion calculates the print coverage of the sheet. The storage portion stores the history of the print coverage calculated by the print coverage calculating portion. The control portion makes the image forming portion form a cleaning toner image to be supplied to the image bearing element at time of cleaning by the cleaning element. The control portion obtains an average value of the print coverage in a period from after a previous cleaning by the cleaning element until before a current cleaning by the cleaning element, and determines an amount of toner for the cleaning toner image to be supplied to the image bearing element based on the average value.

The foregoing and other features and attendant advantages of the present invention will become more apparent from the reading of the following detailed description of the invention in conjunction with the accompanying drawings.

BRIEF DESCRIPTION OF THE DRAWINGS

FIGS. 2A and 2B show exemplary print coverage information and cleaning information that a storage portion stores;

DETAILED DESCRIPTION OF THE INVENTION

Figure 1:
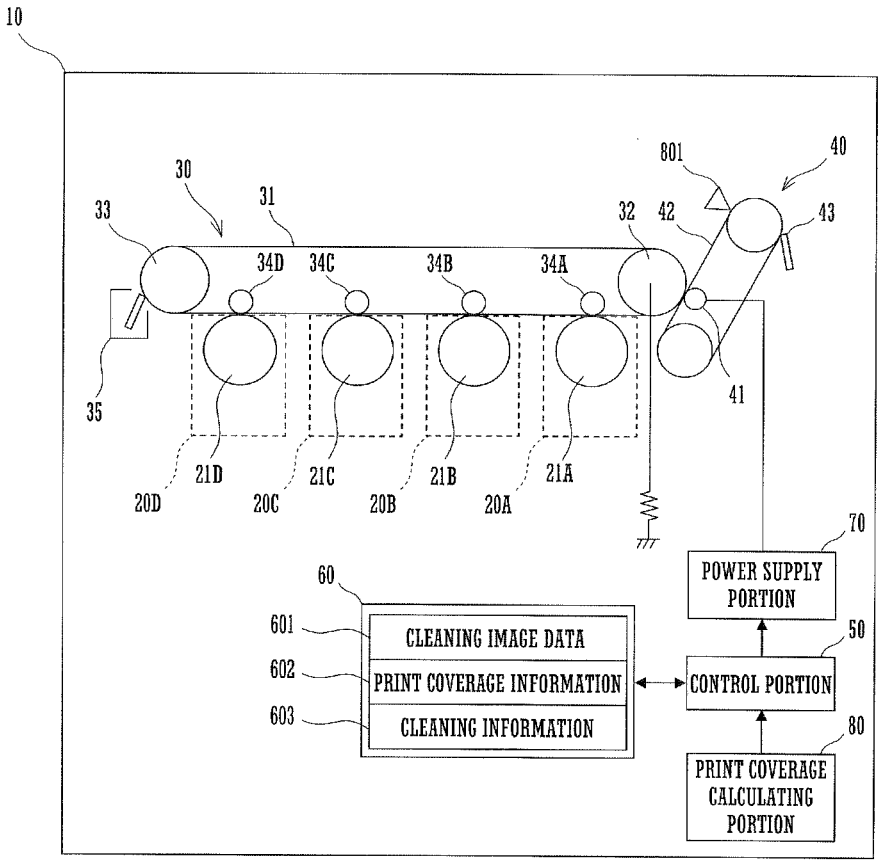
FIG. 1 is a view showing a configuration of a section of concern of an image forming apparatus according to an embodiment of the present invention.

As shown in FIG. 1, an image forming apparatus 10 includes image forming units 20A to 20D, an intermediate transfer unit 30, a secondary transfer unit 40, a control portion 50, a storage portion 60, a power supply portion 70, and a print coverage calculating portion 80. The image forming apparatus 10 performs a multi-color image forming process or a monochrome image forming process in an electrophotographic system on a sheet as a recording medium, using image data input from an external device (not shown).

The image forming units 20A to 20D each form a toner image in a respective one of the colors, that is, black (Bk), cyan (C), magenta (M), and yellow (Y) on each of the surfaces of the photoreceptor drums 21A to 21D by electrophotographic image forming processes.

The intermediate transfer unit 30 has a belt-like intermediate transfer element 31 (which is equivalent to an image bearing element of the present invention), a driving roller 32, a driven roller 33, primary transfer rollers 34A to 34D (which are equivalent to image forming portions of the present invention), and a cleaning unit 35. The intermediate transfer element 31 is stretched over the driving roller 32 and the driven roller 33 and moves along a circulation route that passes the image forming units 20D, 20C, 20B, and 20A in this order. The primary transfer rollers 34A to 34D primarily transfer the toner images formed on the peripheral surfaces of the respective photoreceptor drums 21A to 21D onto the surface of the intermediate transfer element 31. The cleaning unit 35 collects the toner that remains on the surface of the intermediate transfer element 31.

In the color image forming process, a yellow (Y) toner image, a magenta (M) toner image, a cyan (C) toner image, and a black (Bk) toner image are sequentially transferred onto the surface of the intermediate transfer element 31 in an overlaying manner while the intermediate transfer element 31 moves along the circulation route. In the monochrome image forming process, only a black (Bk) toner image is transferred onto the surface of the intermediate transfer element 31 while the intermediate transfer element 31 moves along the circulation route.

The secondary transfer unit 40 is equipped with a secondary transfer roller 41, a secondary transfer belt 42 (which is equivalent to the transfer element of the present invention), and a secondary transfer belt cleaning element 43. The secondary transfer belt 42 is stretched over a plurality of rollers and moves along a predetermined circulation route. The secondary transfer roller 41 is opposed to the driving roller 32 with the secondary transfer belt 42 and the intermediate transfer element 31 held between the rollers 41 and 32. The secondary transfer unit 40 secondarily transfers the toner image on the surface of the intermediate transfer element 31 to the sheet that has been fed to a secondary transfer position between the intermediate transfer element 31 and the secondary transfer belt 42. The secondary transfer belt cleaning element 43 cleans the surface of the secondary transfer belt 42. The secondary transfer roller 41 is applied, from the power supply portion 70, with a transfer voltage with a polarity opposite to the polarity of the charged toner. It should be noted that the driving roller 32 is grounded.

The sheet onto which the toner image is transferred is heated and pressurized while passing a non-shown fixing device and is output to the outside in a state in which the toner image is fixed onto the surface of the sheet firmly.

The control portion 50 controls each part of the image forming apparatus 10 in an integrated manner. The control portion 50 is connected to the storage portion 60, the power supply portion 70, and the print coverage calculating portion 80. The storage portion 60 stores cleaning image data 601, print coverage information 602, and cleaning information 603. The cleaning image data 601 is image data for forming a cleaning toner image over the whole area of an image formation area in the photoreceptor drum 21A in the axial direction of the photoreceptor drum 21A. The print coverage information 602, as shown in FIG. 2A as an example, registers a history of the print coverage for every one sheet of paper. The history of print coverage includes a date, hour, and minute at which the image forming process has been performed; and the print coverage of the sheet on which the image forming process has been performed. The cleaning information 603, as shown in FIG. 2B as an example, registers a history of cleaning. The history of cleaning includes the date, hour, and minute at which cleaning has been performed.

The print coverage calculating portion 80 may preferably calculate an image dot ratio of the image data for black color as the print coverage during the monochrome image formation, and calculate an added value of respective image dot ratios of the image data for respective colors as the print coverage during the color image formation. The image dot ratio may preferably indicate a value obtained by dividing an area of an image part by an area of the sheet, the image part being converted from the number of dots of an ON signal in the image data. The print coverage calculating portion 80 can preferably include a sensor 801 and may also calculate the print coverage of the sheet based on the image data that the sensor 81 has read from the sheet onto which the toner image has been transferred.

The control portion 50, at the time of cleaning the intermediate transfer element 31 and the secondary transfer belt 42, controls the power supply portion 70 that applies the transfer voltage for transferring the cleaning toner image from the intermediate transfer element 31 to the secondary transfer belt 42.

Figure 3:
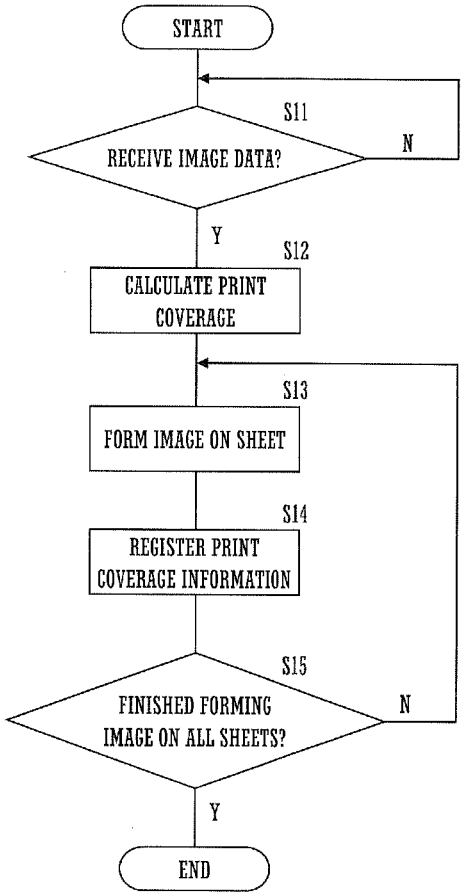
FIG. 3 is a flowchart showing a part of a process procedure of a control portion of the image forming apparatus.

As shown in FIG. 3, the control portion 50, when receiving the image data (S11) after calculating print coverage by the print coverage calculating portion 80 (S12), forms an image on a sheet using the image data (S13). The control portion 50 registers the current date, hour, and minute and the calculated print coverage in the print coverage information 602 (S14). The control portion 50 repeats performing the processes of S13 and S14 until completing forming the image to all the sheets (S15).

Figure 4:
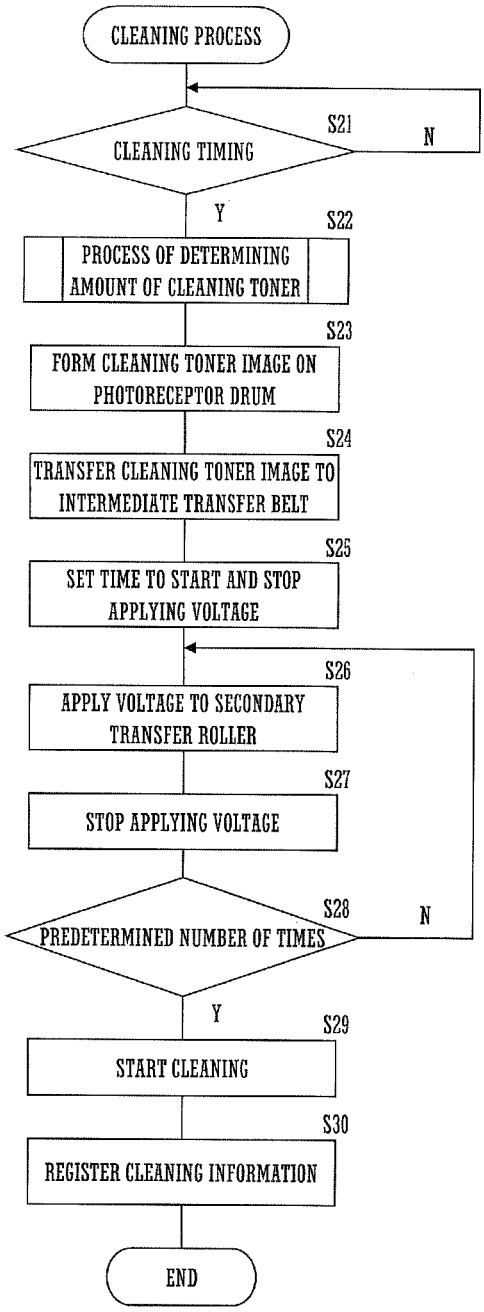
FIG. 4 is a flowchart showing a cleaning process procedure of the control portion.

As shown in FIG. 4, the control portion 50, at time of a startup of the image forming apparatus 10, waits for a predetermined cleaning timing such as when receiving a cleaning instruction after a predetermined period of time passes from the previous cleaning timing (S21), and performs a process of determining the amount of cleaning toner when the cleaning timing comes (S22).

In the process of determining the amount of cleaning toner, the control portion 50 calculates an average value M of the print coverage in the predetermined period with reference to the print coverage information 602 and the cleaning information 603. The predetermined period is a period from after the previous cleaning by the cleaning element until before the current cleaning.

The control portion 50 determines the amount of toner so that the amount of cleaning toner to be supplied to the intermediate transfer element 31 decreases as the average value M of the print coverage is higher. The control portion 50 determines the amount of toner by adding the amount of cleaning toner to be supplied to the intermediate transfer element 31 and the predetermined amount of cleaning toner to be supplied to the secondary transfer belt 42, as the amount of cleaning toner. The control portion 50, in a case in which the added amount of toner exceeds the predetermined amount, reduces the amount of cleaning toner to be supplied to each of the intermediate transfer element 31 and the secondary transfer belt 42 so that the added amount of toner does not exceed the predetermined amount. The predetermined amount is the maximum toner amount that can be supplied to the intermediate transfer element 31 since excess toner may leak from the intermediate transfer element 31 at a time of supply of the cleaning toner when the amount of toner is too high.

Then, the control portion 50 forms on the surface of the photoreceptor drum 21A a cleaning toner image of the amount of cleaning toner determined by the process of determining the amount of cleaning toner, by using the cleaning image data 601 stored in the storage portion 60 (S23). The control portion 50 applies the transfer voltage with a polarity (e.g., positive polarity) opposite to the polarity (e.g., negative polarity) of the charged toner to the primary transfer roller 34A by the power supply portion 70, and transfers the cleaning toner image onto the surface of the intermediate transfer element 31 (S24). It is to be noted that the cleaning toner image may be formed on each of the photoreceptor drums 21A to 21D and may be transferred onto the surface of the intermediate transfer element 31.

Figure 5A:
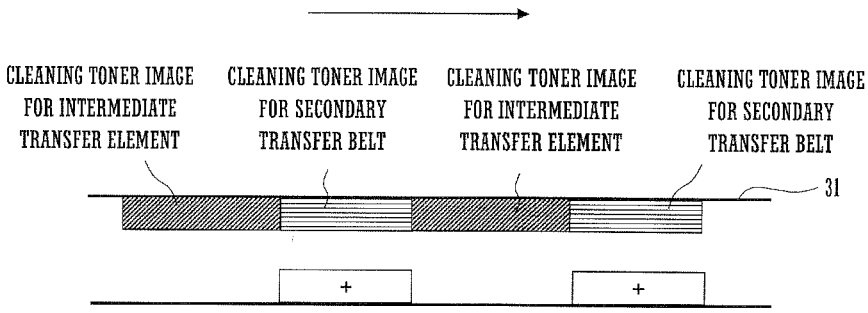
FIGS. 5A and 5B are views showing a state in which a voltage is applied and a state in which a polarity of the voltage is changed at time of transferring a cleaning toner image from an intermediate transfer element to a secondary transfer belt.

The control portion 50 sets time to start applying the transfer voltage and time to stop applying the transfer voltage based on the amount of toner for the cleaning toner image to be supplied to each of the intermediate transfer element 31 and the secondary transfer belt 42 (S25). As shown in FIG. 5A, the cleaning toner image, during the application of the transfer voltage, is transferred from the intermediate transfer element 31 to the secondary transfer belt 42, and, during the stop application of the transfer voltage, is not transferred from the intermediate transfer element 31 to the secondary transfer belt 42, but remains on the intermediate transfer element 31.

The control portion 50 applies the transfer voltage to the secondary transfer roller 41 by using the power supply portion 70 only during the time to apply the transfer voltage (S26), and stops applying the transfer voltage to the secondary transfer roller 41 only during the time to stop applying the transfer voltage (S27). The control portion 50 repeats switching between the application of the transfer voltage and the stop application of the transfer voltage for the predetermined number of times (not less than twice) by the power supply portion 70 (S28). That is, the control portion 50 may divide the cleaning toner image into at least four sections and switches between the application of the transfer voltage and the stop application of the transfer voltage by the power supply portion 70 so that a section in which the cleaning toner image is transferred to the secondary transfer belt 42 and a section in which the cleaning toner image is not transferred, but remains on the intermediate transfer element 31 are alternately formed.

The control portion 50, after finishing formation of the cleaning toner image by repeating switching between the application of the transfer voltage and the stop application of the transfer voltage each for the predetermined number of times, starts cleaning with the intermediate transfer belt cleaning element 351 and with the secondary transfer belt cleaning element 43 (S29). The control portion 50 registers the current date, hour, and minute (a timing when the cleaning has been performed) in the cleaning information 603 (S30).

As described above, the control portion 50 supplies the cleaning toner to the intermediate transfer element 31 so that the amount of cleaning toner decreases as the average value M of the print coverage is higher, and supplies the predetermined amount of cleaning toner to the secondary transfer belt 42. Accordingly, the control portion 50 can supply a proper amount of the cleaning toner to the intermediate transfer element 31 according to the amount of residual toner that adheres to the intermediate transfer element 31 and the amount of paper powder since the amount of residual toner that adheres to the intermediate transfer element 31 increases and the amount of paper powder decreases as the print coverage becomes higher.

In addition, the control portion 50 may intermittently and simultaneously form the cleaning toner images on the intermediate transfer element 31 and the secondary transfer belt 42 in the sheet feed direction. Thus, the control portion 50 can shorten the time for forming the cleaning toner images on the intermediate transfer element 31 and the secondary transfer belt 42 and can also shorten cleaning time. In order that the cleaning toner image is intermittently formed in the feed direction of the sheet, at the time of cleaning, the cleaning toner is not likely to leak from between the intermediate transfer belt cleaning element 351 and the intermediate transfer element 31, and between the secondary transfer belt cleaning element 43 and the secondary transfer belt 42 in the direction perpendicular to the feed direction of the sheet.

Figure 5B:
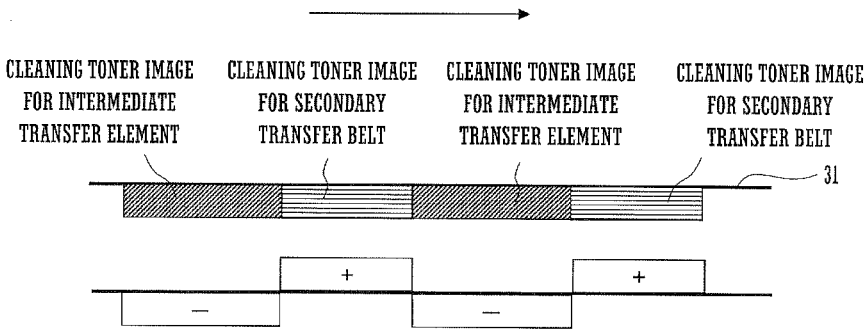

It is to be noted that, as shown in FIG. 5B, the control portion 50 may apply the transfer voltage to the secondary transfer roller 41 by switching the transfer voltage with a polarity (e.g., positive polarity) opposite to the polarity (e.g., negative polarity) of the charged toner and the transfer voltage with a polarity (e.g., negative polarity) the same as the polarity (e.g., negative polarity) of the charged toner. This can ensure that the cleaning toner image is transferred from the intermediate transfer element 31 to the secondary transfer belt 42 when the transfer voltage with a polarity opposite to the polarity of the charged toner is applied, and the cleaning toner image remains on the intermediate transfer belt 31 when the transfer voltage with a polarity the same as the polarity of the charged toner is applied.

Without storing the cleaning information 603 in the storage portion 60, the control portion 50 can also delete the history of the print coverage registered in the print coverage information 602 in the process of S30.

The control portion 50, in the process of determining the amount of cleaning toner, can also determine the amount of cleaning toner that is allocated to each of the intermediate transfer element 31 and the secondary transfer belt 42 so that the amount of cleaning toner that is allocated and supplied to the intermediate transfer element 31 out of the predetermined amount of cleaning toner may decrease as the average value M of the print coverage in the predetermined period becomes higher.

Corresponding to a state in which the amount of residual toner increases and the amount of paper powder decreases as the print coverage is higher, a proper amount of cleaning toner can be supplied according to the amount of residual toner that adheres to the intermediate transfer element 31 and the amount of paper powder.

In the process of determining the amount of cleaning toner, the control portion 50 can also adjust the amount of toner so that the sum of the amount of cleaning toner that is supplied to each of the intermediate transfer element 31 and the secondary transfer belt 42 does not exceed the predetermined amount, the amount of cleaning toner being determined so as to decrease as the average value M of the print coverage becomes higher. The predetermined amount is the maximum toner amount that does not cause the leakage of toner from the intermediate transfer element 31 at the time of supply of the cleaning toner.

The control portion 50, in the process of determining the amount of cleaning toner, can also determine the amount of cleaning toner for the intermediate transfer element 31 and the secondary transfer belt 42 according to the number of sheets P and the average value M of the print coverage.

Figure 6:
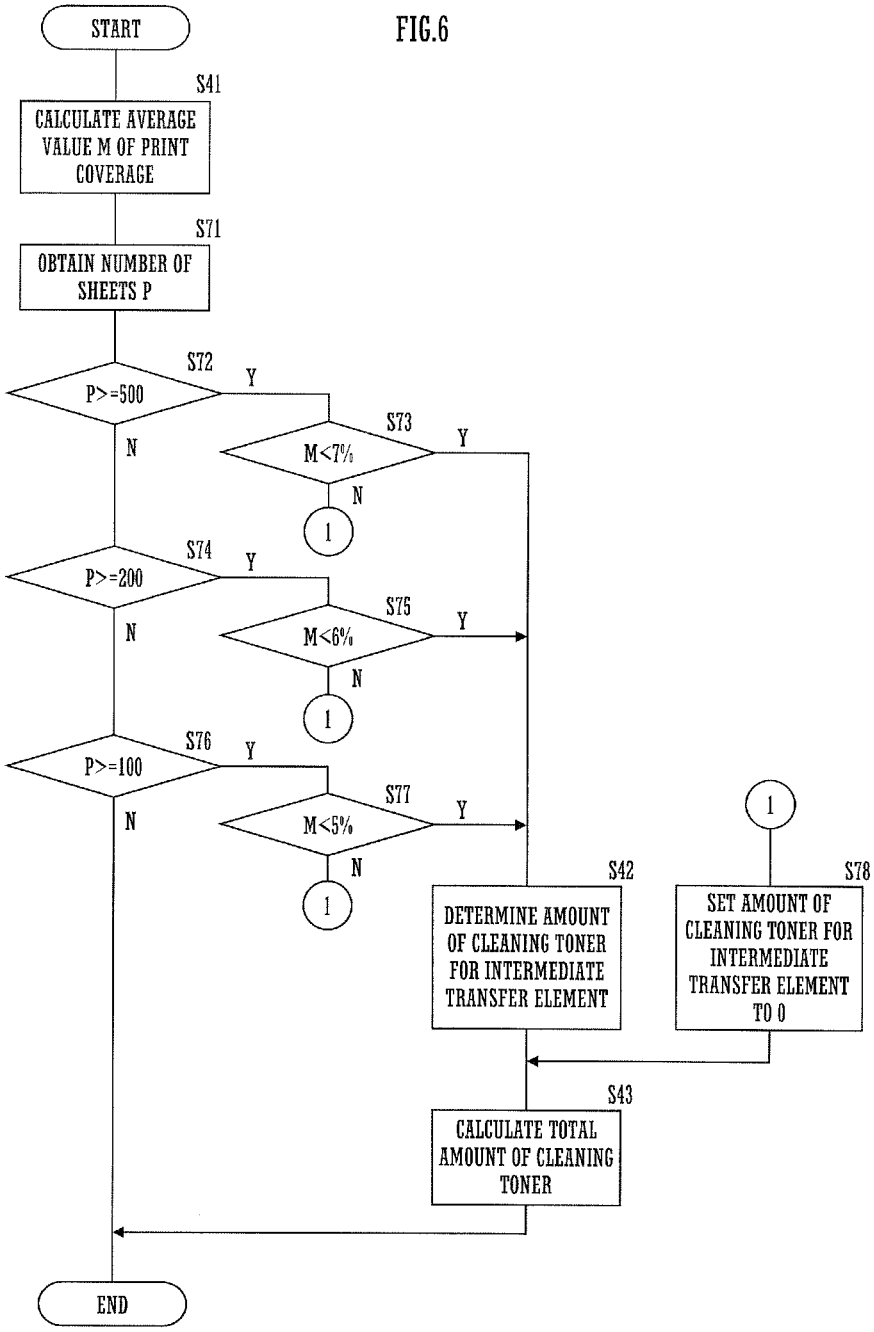
FIG. 6 is a flowchart showing control steps of a process for determining an amount of cleaning toner of the control portion.

For example, as shown in FIG. 6, the control portion 50 calculates the average value M of the print coverage in the predetermined period (S41) and then obtains the number of sheets P in the predetermined period (S71). The control portion 50, when the number of sheets P is not less than 500 (S72), determines whether or not the average value M is less than 7% (S73). The control portion 50, when the average value M is less than 7%, determines the amount of toner so that the amount of cleaning toner to be supplied to the intermediate transfer element 31 decreases as the average value M of the print coverage is higher (S42), and calculates the sum of the amount of cleaning toner to be supplied to the intermediate transfer element 31 and the secondary transfer belt 42 (S43). The control portion 50, when the average value M is not less than 7%, sets the amount of cleaning toner to be supplied to the intermediate transfer element 31 to zero (S78), and proceeds to the process of S43.

The control portion 50, when the number of sheets P is not less than 200 and less than 500 (S74), determines whether or not the average value M is less than 6% (S75). The control portion 50 performs the process of S42 when the average value M is less than 6% and performs the process of S78 when the average value M is not less than 6%.

The control portion 50, when the number of sheets P is not less than 100 and less than 200 (S76), determines whether or not the calculated average value M is less than 5% (S77). The control portion 50 performs the process of S42 when the average value M is less than 5% and performs the process of S78 when the average value M is not less than 5%.

The control portion 50 ends the process when the number of sheets P is less than 100.

In the above processes, the control portion 50 determines whether or not to supply the cleaning toner for forming a cleaning toner image to the intermediate transfer element 31 based on the number of sheets P and the average value M of the print coverage, and determines the amount of cleaning toner to be supplied to the intermediate transfer element 31 based on the average value M of the print coverage. The control portion 50 can determine whether or not to supply the cleaning toner to the intermediate transfer element 31 according to the amount of paper powder of the sheet that adheres to the intermediate transfer element 31, and can determine the amount of cleaning toner to be supplied to the intermediate transfer element 31.

It should be noted that the control portion 50, when it is possible to determine that the amount of paper powder of the sheet that adheres to the intermediate transfer element 31 is low, can postpone the cleaning process. For example, the cleaning is not performed until when the number of sheets P is not less than 200 in a case in which the number of sheets P is not less than 100 and less than 200 and the average value M of the print coverage is not less than 5%, and the cleaning is not performed until when the number of sheets P is not less than 500 in a case in which the number of sheets P is not less than 200 and less than 500 and the average value M of the print coverage is not less than 6%.

Figure 7A:
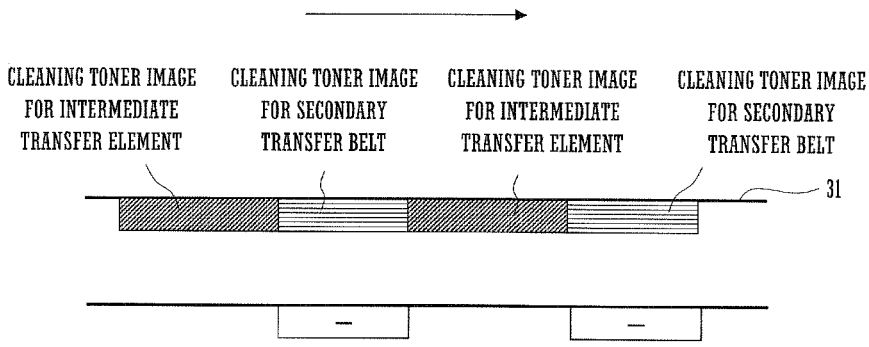
FIGS. 7A and 7B are views showing a state in which a voltage is applied and a state in which a polarity of the voltage is changed at time of transferring a cleaning toner image from an intermediate transfer element to a secondary transfer belt.

It is to be noted that, in a case in which the power supply portion 70 is connected to the driving roller 32 (which is equivalent to a back-up roller of the present invention), and the secondary transfer roller 41 is grounded, as shown in FIG. 7A, the power supply portion 70 applies the transfer voltage with a polarity (e.g., negative polarity) the same as the polarity (e.g., negative polarity) of the charged toner to the driving roller 32. The cleaning toner image, while the transfer voltage is being applied, can be transferred reliably from the intermediate transfer element 31 to the secondary transfer belt 42, and, while the application of the transfer voltage is being stopped, the cleaning toner image is not transferred from the intermediate transfer element 31 to the secondary transfer belt 42, but will reliably remain on the intermediate transfer element 31.

Figure 7B:
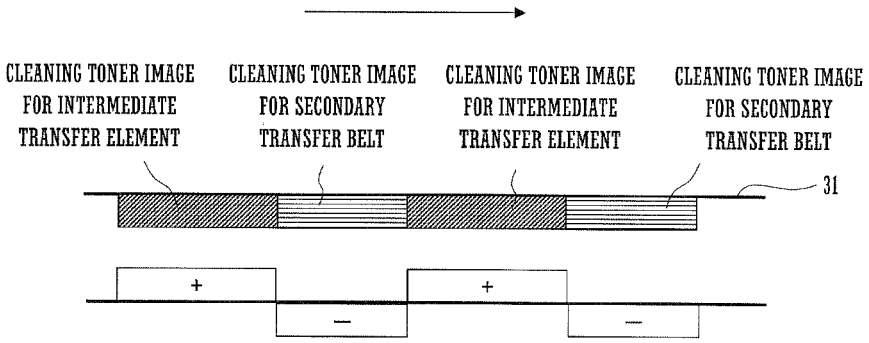

In addition, as shown in FIG. 7B, the control portion 50 may apply the transfer voltage to the secondary transfer roller 41 by switching the transfer voltage with a polarity opposite to the polarity of the charged toner and the transfer voltage with a polarity the same as the polarity of the charged toner. This can further ensure that the cleaning toner image is transferred from the intermediate transfer element 31 to the secondary transfer belt 42 when the transfer voltage with a polarity the same as the polarity of the charged toner is applied, and, when the transfer voltage with a polarity opposed to the polarity of the charged toner is applied, this can also further ensure that the cleaning toner image remains on the intermediate transfer belt 31.

Figure 8:
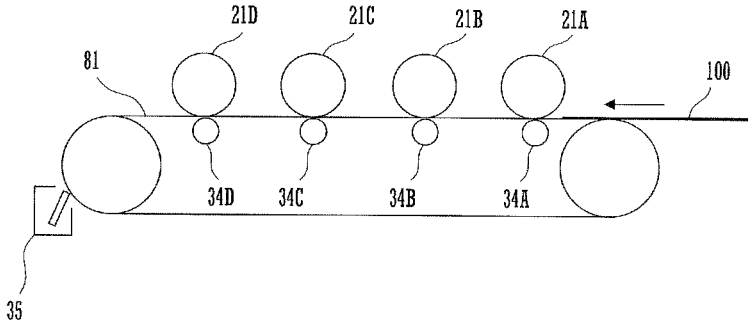
FIG. 8 is a view showing a configuration of a section of concern of an image forming apparatus according to another embodiment of the present invention.

It should be noted that, as shown in FIG. 8, the present invention can be employed similarly in an image forming apparatus that directly transfers the toner images on the photoreceptor drums 21A to 21D to a sheet 100 that is fed on a paper feed belt 81 by the transfer rollers 34A to 34D by using the photoreceptor drums 21A to 21D as image bearing elements and the paper feed belt 81 as the transfer element.

Finally, the above described embodiments are to be considered in all respects as illustrative and not restrictive. The scope of the present invention is defined not by above described embodiments but by the claims. Further, the scope of the present invention is intended to include all modifications that come within the meaning and scope of the claims and any equivalents thereof.

What is claimed is:

1. An image forming apparatus comprising:

an image bearing element that bears a toner image to be transferred onto a sheet;

an image forming portion that forms the toner image on the image bearing element;

a cleaning element that cleans a surface of the image bearing element;

a print coverage calculating portion that calculates print coverage of the toner image;

a storage portion that stores a history of the print coverage calculated by the print coverage calculating portion; and a control portion that makes the image forming portion form a cleaning toner image to be supplied to the image bearing element at time of cleaning by the cleaning element, the control portion obtaining an average value of the print coverage for a predetermined period, the print coverage being stored in the storage portion, and determining an amount of toner for the cleaning toner image that is supplied to the image bearing element based on the average value, wherein the predetermined period is a period from after a previous cleaning by the cleaning element until before a current cleaning by the cleaning element.

2. The image forming apparatus according to claim 1, wherein:

the storage portion further stores a number of sheets onto which the toner image is transferred; and the control portion obtains the average value of the print coverage for the predetermined period, the print coverage being stored in the storage portion, at the time of cleaning by the cleaning element; and determines whether or not to supply the cleaning toner image based on the number of sheets that is stored in the storage portion and the obtained average value.

3. The image forming apparatus according to claim 1, further comprising:

a plurality of photoreceptors for respective colors including a photoreceptor for black color, wherein:

the image bearing element is an intermediate transfer element;

the image forming portion forms the toner image on the image bearing element through the photoreceptor for black color by using image data for black color during monochrome image formation, and forms the toner image on the image bearing element through the photoreceptors for respective colors by using image data for respective colors during color image formation;

the print coverage calculating portion calculates an image dot ratio of the image data for black color as the print coverage during the monochrome image formation, and calculates an added value of respective image dot ratios of the image data for respective colors as the print coverage during the color image formation; and the image dot ratio indicates a value obtained by dividing an area of an image part by an area of the sheet, the image part being converted from a number of dots of an ON signal in the image data.

4. The image forming apparatus according to claim 1, wherein:

the print coverage calculating portion comprises a sensor that reads an image on the sheet onto which the toner image has been transferred; and the print coverage calculating portion calculates an image area ratio obtained by dividing an integrated area of an image part of the sheet by an area of the sheet as the print coverage from data of the image read by the sensor.

5. The image forming apparatus according to claim 1, further comprising:

a transfer element that transfers the toner image on the image bearing element onto the sheet;

a transfer element cleaning element that cleans a surface of the transfer element;

a power supply portion that applies transfer voltage for transferring the toner image from the image bearing element to the transfer element, wherein:

the control portion successively forms, through the image forming portion, a plurality of the cleaning toner images that are supplied to the image bearing element and the transfer element in a feed direction of the sheet at the time of cleaning by the cleaning element and the transfer element cleaning element; and controls the power supply portion so as to divide the successively formed cleaning toner images into at least four sections and then intermittently transfer the divided cleaning toner images to the transfer element.

* * * * *